US006362749B1

(12) United States Patent
Brill

(10) Patent No.: US 6,362,749 B1
(45) Date of Patent: Mar. 26, 2002

(54) EMERGENCY VEHICLE DETECTION SYSTEM

(76) Inventor: William E. Brill, 1407 La Salina St., Oceanside, CA (US) 92054-5433

( * ) Notice: Subject to any disclaimer, the term of this patent is extended or adjusted under 35 U.S.C. 154(b) by 0 days.

(21) Appl. No.: 09/882,393

(22) Filed: Jun. 18, 2001

(51) Int. Cl.[7] ..... G08G 1/00

(52) U.S. Cl. ..... 340/902; 340/904; 340/943; 340/693.3; 367/93; 174/36; 381/56

(58) Field of Search ..... 340/902, 904, 340/943, 693.3; 367/93; 174/36; 381/56

(56) References Cited

U.S. PATENT DOCUMENTS

| | | | | | |
|---|---|---|---|---|---|
| 4,212,085 | A | * | 7/1980 | Vaillancour et al. | 340/902 |
| 4,864,297 | A | * | 9/1989 | Shaw et al. | 340/902 |
| 5,710,555 | A | * | 1/1998 | McConnell et al. | 340/902 |
| 5,894,279 | A | * | 4/1999 | Rose et al. | 340/902 |
| 5,926,112 | A | * | 7/1999 | Hartzell | 340/902 |

* cited by examiner

*Primary Examiner*—Daniel J. Wu
(74) *Attorney, Agent, or Firm*—David Guerra

(57) ABSTRACT

An emergency vehicle detection system for alerting a driver of an approaching emergency vehicle includes a sound signal-producing unit mounted on an emergency vehicle, a sound signal detection unit mounted on a non-emergency vehicle, and a display unit remotely located on the non-emergency vehicle. The sound signal-producing unit has a sound generator for producing and transmitting a sound signal. A switch is used for controlling the operation of the sound generator in combination with a siren. The sound signal detection unit has at least one sound transducer for detecting sound signals and producing an electric current upon detection of a signal. A signal comparator is connected to the sound transducers for comparing the currents from the transducers to preprogrammed patterns. If there is matching pattern, a signal output encoder connected to the signal comparator constructs an encoded signal and transmits the encoded signal to a remotely located display unit through a transmitter. The display unit has a receiver for receiving the encoded signal and for passing it to a signal comparator to compare the encoded signal to known patterns and to activate at least one illumination device upon detection of a matched pattern.

11 Claims, 3 Drawing Sheets

EMERGENCY VEHICLE DETECTION SYSTEM

BACKGROUND OF THE INVENTION

1. Field of the Invention

The present invention relates to an emergency vehicle detection system and more particularly pertains to the directional detecting and remote displaying of an approaching emergency vehicle through simple and effective components.

2. Description of the Prior Art

The use of emergency vehicle warning devices of various designs and configurations is known in the prior art. For example, U.S. Pat. No. 5,926,112 to Hartzell discloses a system for warning an occupant in a vehicle of an approaching emergency vehicle. The disclosure teaches the use of a transmitter mounted on an emergency vehicle and a receiver located on a non-emergency vehicle. The receiver warns the occupant by way of a flashing indicator light.

U.S. Pat. No. 6,011,492 to Garashe discloses a system to warn vehicles of the approach of another vehicle by having a transceiver in each vehicle. The disclosure teaches the use of a visual stimulus to alert the driver of one vehicle to the nearby vicinity of another vehicle that is transmitting an emergency signal. The transceiver is operated in conjunction with the vehicle's audible warning devices.

U.S. Pat. No. 3,626,365 to Press et al. discloses a vehicle warning and directional detection system for detecting the audible sounds of a vehicle in the vicinity. The disclosure teaches the use of multiple audible receivers to warn a driver of an approaching vehicle by way of a directional display.

U.S. Pat. No. 5,894,279 to Rose et al. discloses an emergency vehicle detection system for detecting and warning a driver of the approach of an emergency vehicle. The disclosure teaches the use of multiple microphones to detect audio signals from an emergency vehicle. Furthermore, the disclosure teaches the use of a level detector to filter the signal.

Lastly, U.S. Pat. No. 4,806,931 to Nelson discloses a system for receiving and discriminating sound patterns from the siren of an emergency vehicle so as to control a traffic signal light. The disclosed system teaches the use of multiple directional microphones and a preprogrammed microprocessor to control the operations of a traffic signal light in response to a matching signal pattern.

While these devices fulfill their respective, particular objectives and requirements, the aforementioned patents do not describe an emergency vehicle detection system that allows the directional detecting and remote displaying of an approaching emergency vehicle through simple and effective components. The U.S. Pat. No. 5,926,112 makes no provision for the use of ultra-sound as the transmission medium and its electronic components to bypass the existing siren. Furthermore, there is no teaching to use a remotely located directional display device located in the non-emergency vehicle. The U.S. Pat. No. 6,011,492 does not teach the use of an ultra-sound producing device to transmit a signal to a nearby vehicle and the use of a remotely located direction display device. The U.S. Pat. No. 20 3,626,365 makes no provisions for a vehicle mounted ultra-sound transmitter using a directional display located in a remote area from a receiver. The U.S. Pat. No. 5,894,279 does not teach the use of a directional display device remotely located from a receiver. Also, there is not teaching of the use of an ultra-sound transmitter mounted on the emergency vehicle.

Lastly, the U.S. Pat. No. 4,806,931 does not teach the use of an emergency vehicle mounted ultra-sound transmitter and a receiver having a remotely located directional display device.

In this respect, the emergency vehicle detection system according to the present invention substantially departs from the conventional concepts and designs of the prior art, and in doing so provides an apparatus primarily developed for the purpose of directionally detecting and remotely displaying of the approach of an emergency vehicle through simple and effective components.

Therefore, it can be appreciated that there exists a continuing need for a new and improved emergency vehicle detection system which can be used for the directional detecting and remote displaying of the approach of an emergency vehicle through simple and effective components. In this regard, the present invention substantially fulfills this need.

SUMMARY OF THE INVENTION

In view of the foregoing disadvantages inherent in the known types of emergency vehicle warning devices of now present in the prior art, the present invention provides an improved emergency vehicle detection system. As such, the general purpose of the present invention, which will be described subsequently in greater detail, is to provide a new and improved emergency vehicle detection system and method which has all the advantages of the prior art and none of the disadvantages.

To attain this, the present invention essentially comprises an ultra-sound signal producing unit mounted on an emergency vehicle, an ultra-sound signal detection unit mounted on a vehicle, and a display unit remotely located on the vehicle. The ultra-sound signal-producing unit has an ultra-sound generator that produces and transmits ultra-sound away from the emergency vehicle. A switch that can activate the ultra-sound generator alone or in combination with a siren controls the ultra-sound generator. A logic gate is used to determine the circuit activated by the switch. The ultra-sound signal detection unit has at least one specific frequency directional ultra-sound transducer mounted on the exterior of the vehicle for producing an electric current of certain characteristics of greater or lesser strength according to the amplitude of the signal. A signal comparator is connected to the transducer for comparing the currents to preprogrammed patterns. A signal strength detector receives the currents from the comparator and activates a circuit corresponding to the strongest currents and inhibits the circuits of the weaker currents. A signal strength change detector completes a circuit from the signal strength detector corresponding to an increasing signal or to a decreasing signal. The completed circuit is connected to a signal output encoder for constructing an encoded signal according to the circuits activated by the signal strength detector and the signal strength change detector. A radio transmitter transmits the encoded signal to the display unit. The display unit has a single channel receiver that passes the signal to a signal comparator for comparing the encoded signal to known patterns and for activating a circuit upon a matching pattern. The circuit activates at least one light emitting diode and at least one light emitting diode arrow. An oscillator is used to produce a flashing effect in the light emitting diode and arrow.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved emergency vehicle detection system which has all of the advantages of the prior art emergency vehicle warning devices of known designs and configurations and none of the disadvantages.

It is another object of the present invention to provide a new and improved emergency vehicle detection system which may be easily and efficiently manufactured and marketed.

It is further object of the present invention to provide a new and improved emergency vehicle detection system which is of a durable and reliable construction.

An even further object of the present invention is to provide a new and improved emergency vehicle detection system which is susceptible of a low cost of manufacture with regard to both materials and labor, and which accordingly is then susceptible of low prices of sale to the consuming public, thereby making such emergency vehicle detection system economically available to the buying public.

Even still another object of the present invention is to provide an emergency vehicle detection system for the directional detecting and remote displaying of an approaching emergency vehicle through simple and effective components.

Lastly, it is an object of the present invention to provide a new and improved emergency vehicle detection system for alerting a driver of an approaching emergency vehicle. The detection system has a sound signal-producing unit mounted on an emergency vehicle, a sound signal detection unit mounted on a vehicle and a display unit remotely located on the vehicle. The sound signal-producing unit has a sound generator operated by a switch for producing and transmitting a sound signal. The sound signal detection unit has at least one sound transducer for detecting sound signals and producing an electric current upon detection of a signal. A signal comparator is connected to the sound transducers for comparing the currents from the transducers to preprogrammed patterns. If there is matching pattern a signal output encoder connected to the signal comparator constructs an encoded signal and transmits the encoded signal to a remotely located display unit through a transmitter. The display unit has a receiver for receiving the encoded signal and passing the signal to a signal comparator to compare the encoded signal to know patterns and activating at least one illumination device upon a matched pattern.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
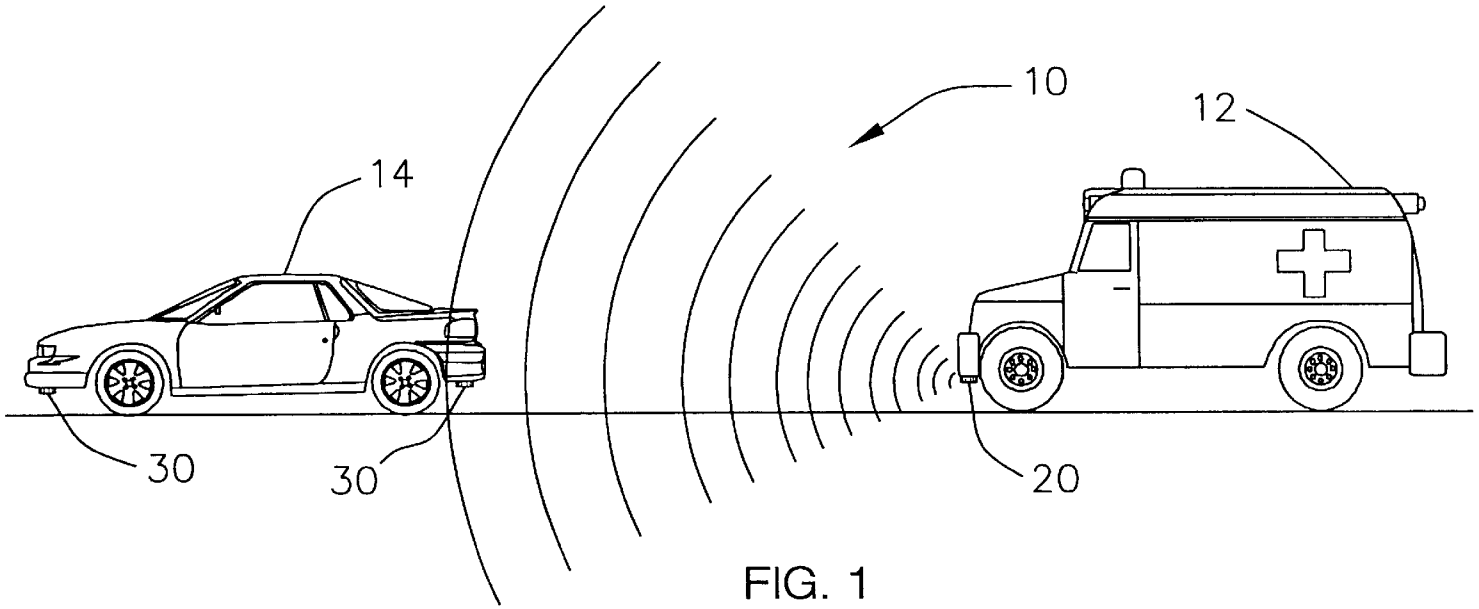
FIG. 1 is a side elevation view of the preferred embodiment of the emergency vehicle detection system constructed in accordance with the principles of the present invention.

With reference now to the drawings, an in particular to FIG. 1, a new and improved emergency vehicle detection system 10 for alerting a driver of an approaching emergency vehicle will be described. More particularly, the emergency vehicle detection system 10 has an ultra-sound signal producing unit 20 mounted on an emergency vehicle 12, and an ultra-sound signal detection unit 30 mounted on a vehicle. The emergency vehicle detection system 10 is not limited to use with only land vehicles, but can be adaptively installed in any transportation device where one transportation device needs to alert another transportation device in the vicinity.

Figure 2:
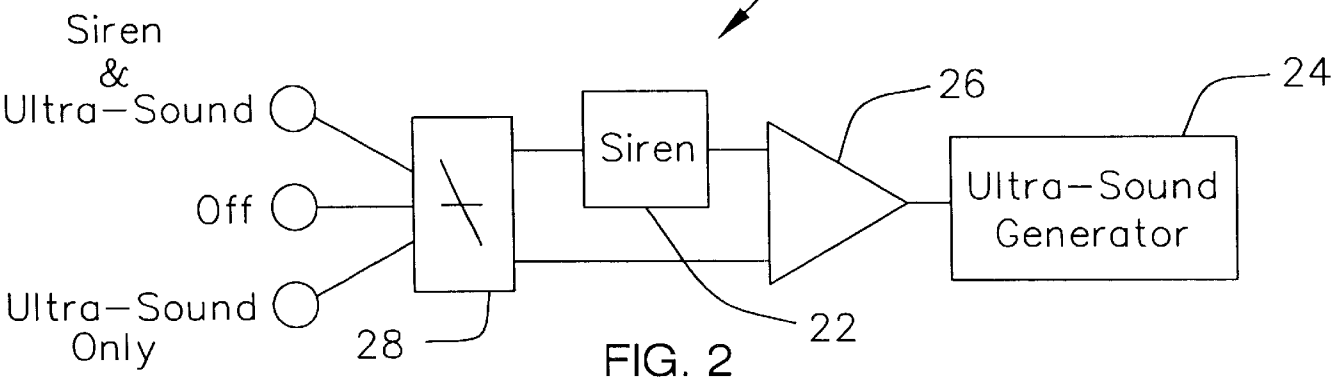
FIG. 2 is a schematic diagram of the ultra-sound signal producing unit of the present invention.

As best illustrated in FIG. 2, the ultra-sound signal-producing unit 20 is connected to an emergency vehicle's audible siren 22 and produces a pulse train signal that is of known frequency, sequence and strength. The ultra-sound signal-producing unit 20 can be activated automatically with the activation of the siren 22, or a subsidiary circuit can be activated that will bypass the siren to allow the operator of the emergency vehicle 12 to signal traffic without the use of the siren. A standard ultra-sound generator 24 is connected to a logic gate 26 to produce the ultra-sound signal, whereby the logic gate is an OR gate. The logic gate 26 allows a signal from either the siren-activated circuit or the bypass circuit to enter the ultra-sound generator 24. A three way switch 28 controls which circuit is activated. The first position turns the ultra-sound producing unit 20 off. The second position activates the bypass circuit that activates the ultra-sound generator 24 without the siren 22. The third position activates the automatic siren circuit whereby when the siren 22 is activated, the ultra-sound generator 24 automatically begins to produce a signal.

Figure 3:
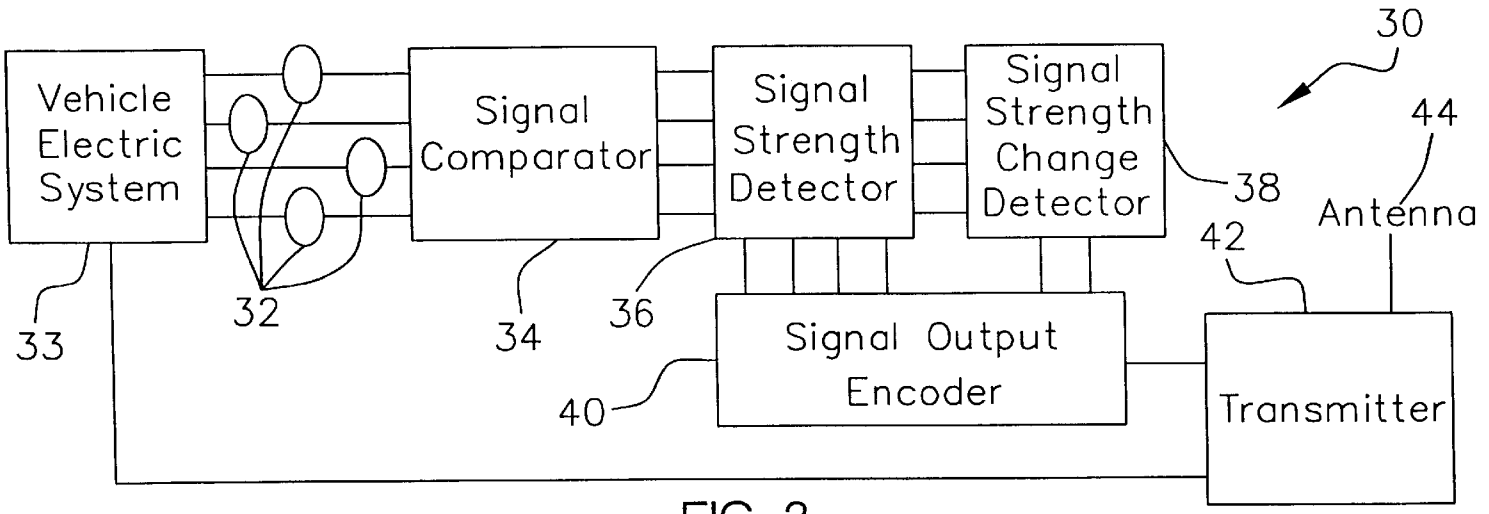
FIG. 3 is a schematic diagram of the ultra-sound signal detection unit of the present invention.

The ultra-sound signal detection unit 30 is mounted on a vehicle in a weatherproof case and mounting hardware. Preferably, the ultra-sound signal detection unit 30 is mounted on the bottom exterior surface of the vehicle 14 to allow for easy and quick installation or repair. The ultra-sound signal detection unit 30 has a plurality of specific frequency directional ultra-sound transducers 32, a signal comparator 34, a signal strength detector 36, a signal strength change detector 38, a signal output encoder 40, and a transmitter 42, all of which are best illustrated in FIG. 3.

The specific frequency directional ultra-sound transducers 32 are connected to a vehicle's existing electrical system 33 and are located on all sides of the vehicle 14 for detecting ultra-sound signals from any direction. When an ultra-sound signal is detected by one of the transducers 32, an electric current is which is of greater or lesser strength according to the amplitude of the signal. The signal amplitude will be greater at the transducer most nearly aligned with the direction in which the signal is originating. The transducers 32 can be mounted to the exterior surface of the vehicle 14 or integrally incorporated into the vehicle's body panels or exterior components. All the transducers 32 are individually connected to the signal comparator 34 for comparing the currents to stored patterns. If the characteristics of the currents from the transducers 32 match the profile in the memory of the comparator 34, the currents will pass to a relative signal strength detector 36. The signal strength detector 36 will activate the circuit corresponding to the strongest current and inhibit the circuits of the weaker signals. The activated circuit from the signal strength detector 36 will connect to the signal output encoder 40 and also to the signal strength change detector 38. The signal strength change detector 38 will complete a circuit corresponding to an increasing signal or to a decreasing signal from the signal strength detector 36. This circuit from the signal strength change detector 38 will also connect to the signal output encoder 40. The signal output encoder 40 will construct an encoded signal according to the circuits activated from the signal strength detector 36 and the signal strength change detector 38. The signal output encoder 40 will then activate a very short-range radio transmitter 42 that will transmit the encoded signal through an antenna 44.

Figure 4:
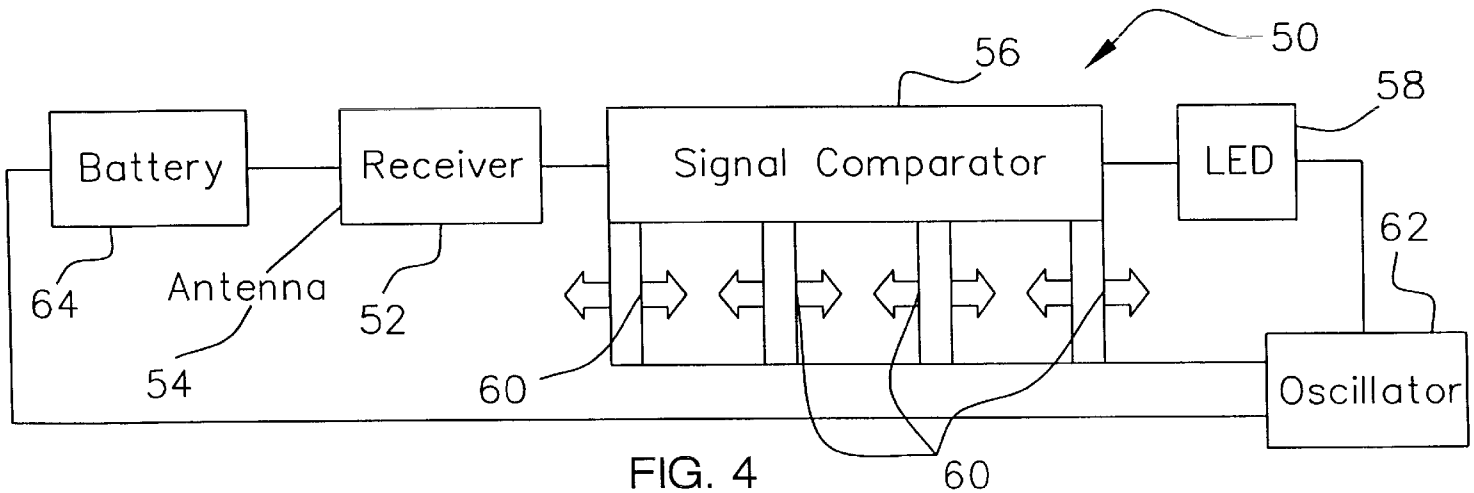
FIG. 4 is a schematic diagram of the warning display unit of the present invention.
Figure 5:
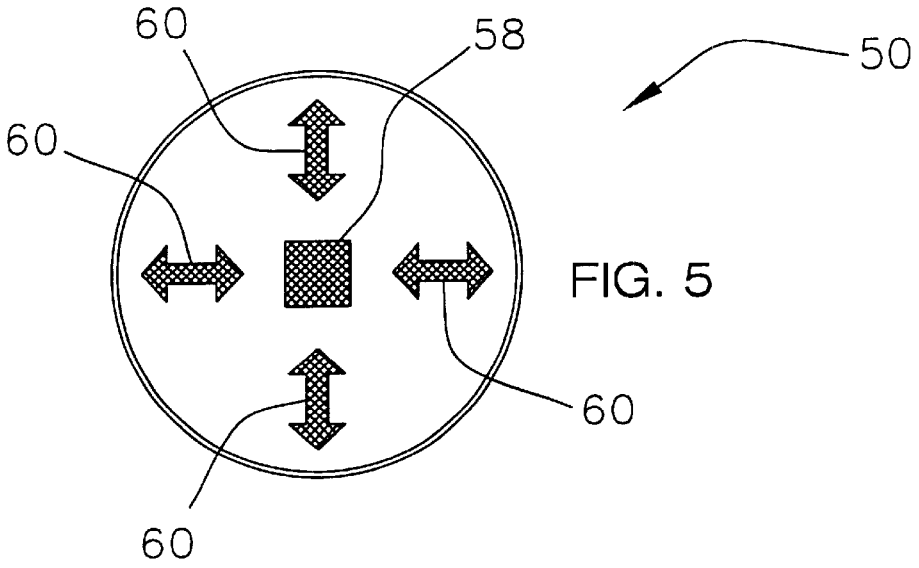
FIG. 5 is a front elevation view of the warning display unit of the present invention.

The display unit 50 is mounted anywhere on the vehicle 14 by means of any standard mounting assembly. The display unit 50, as illustrated in FIGS. 4 and 5, has a single channel receiver 52, an antenna 54, a signal comparator 56, a light emitting diode 58, a plurality of light emitting diode arrows 60, an oscillator 62, and a battery 64. The light emitting diode 58 can be of any geometric configuration, but preferably square. The single channel receiver 52 will detect a radio signal by way of the antenna 54 and pass the signal to the signal comparator 56. The signal comparator 56 will activate a circuit from the battery 64 to the light emitting diode 58 and the light emitting diode arrow 60 that the signal from the comparator 56 specifies. The light emitting diode arrow 60 that is energized will indicate the direction of the signal and is determined by the encoded signal transmitted by the ultra-sound signal detection unit 30. The signal from the light emitting diode 58 and the light emitting diode arrows 60 will pass to the oscillator 62 and back to the battery 64. The oscillator 62 will cause the light emitting diode 58 and arrows 60 to illuminate and flash.

Figure 6:
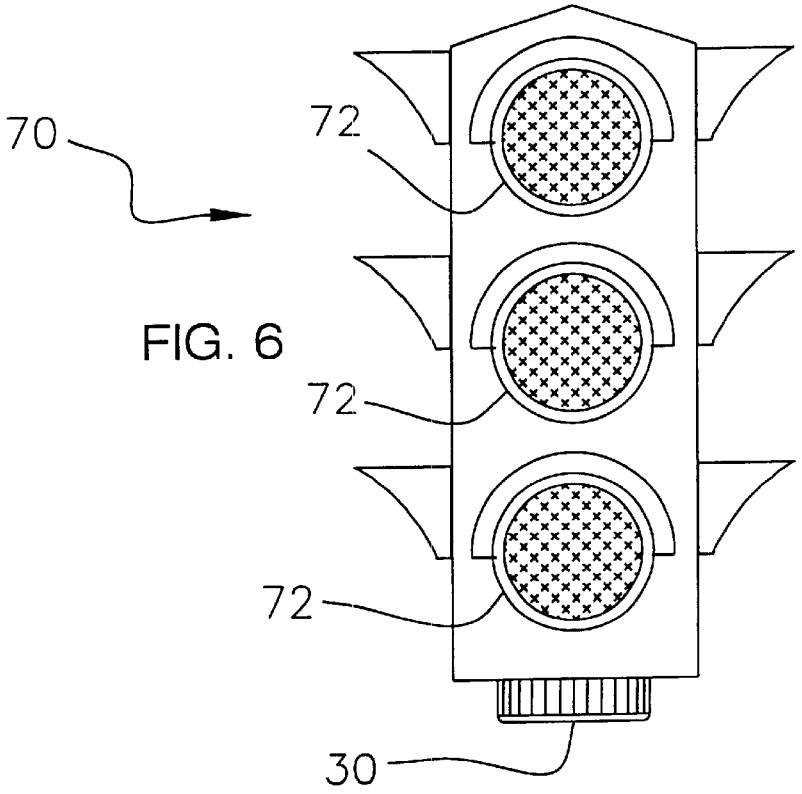
FIG. 6 is a front elevation view of an alternate embodiment of the present invention.

As an alternate embodiment, the signal detection unit 30 can be adapted and modified to be installed into a traffic signal control system 70, as best illustrated in FIG. 6. The new and improved emergency vehicle detection system 10 for traffic signal control systems 70 would have an ultra-sound signal producing unit 20 mounted on an emergency vehicle 12 and a ultra-sound signal detection unit 30 adaptively mounted to a traffic signal system. The ultra-sound signal producing unit 20 comprises of an ultra-sound generator 24, a switch 28, a siren 22 and a logic gate 26. The ultra-sound producing unit is identical to the ultra-sound producing unit in the preferred embodiment described above. The ultra-sound signal detection system has the same components as the ultra-sound signal detection system described in the preferred embodiment except the light emitting diode and the light emitting diode arrows would be replaced with the existing traffic signal lights 72.

In use, it can now be understood that when an ultra-sound pulse train signal is produced by the emergency vehicle within detection range of the signal detection unit, the signal will excite the transducers, producing an electric current of certain characteristics and of greater or lesser strength according to the amplitude of the signal. The signal amplitude will be greater at the transducer most nearly aligned with the direction in which the signal is originating. The currents from the transducers pass to a signal comparator. If the characteristics of the currents fit the profile in the memory of the comparator, the currents will pass to a relative signal strength detector which will activate the circuit corresponding to the strongest current and inhibit the circuits of the weaker signals. The energized circuit will connect with a signal encoder and also to a signal strength change detector. The signal strength change detector will complete a circuit corresponding to an increasing signal or one corresponding to a decreasing signal. This circuit will also connect to the signal encoder. The signal encoder will construct a signal according to the circuits activated and will activate the transmitter, which will transmit the encoded signal.

The warning display unit single channel receiver will pass the signal to a signal comparator, which will activate the circuit from the batter to the center light emitting diode and the light emitting diode arrow that the signal specifies. The circuit will pass from the light emitting diodes to an oscillator and back to the battery, thus causing the indicated light emitting diodes to be illuminated and to flash.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A vehicle detection system comprising, in combination:

a sound signal-producing unit in an emergency vehicle, the sound signal-producing unit including:

a sound generator for producing and transmitting a sound signal away from the emergency vehicle;

a switch for controlling the operation of the sound generator;

a siren connected to the switch;

a logic gate connecting the sound generator to the siren and the switch for activating the sound generator corresponding to the position of the switch;

a sound signal detection unit in a vehicle, the sound signal detection unit including:

at least one sound transducer connected to the existing vehicle electrical system for detecting sound signals and producing an electric current;

a signal comparator connected to the sound transducers for comparing the currents from the transducers to preprogrammed patterns;

a signal strength detector connected to the signal comparator for activating a circuit corresponding to the currents from the signal comparator;

a signal strength change detector connected to the signal strength detector and to the signal output encoder for completing a circuit corresponding to the currents from the signal strength detector;

a signal output encoder connected to the signal strength detector and the signal strength change detector for constructing an encoded signal according to the currents from the signal strength detector and the signal strength change detector;

a transmitter connected to the signal output encoder and to the vehicle electrical system for transmitting the encoded signal from the signal output encoder through an antenna;

a display unit in the vehicle, the display unit including:

a receiver connected to a battery and an antenna for receiving the encoded signal from the transmitter of the sound signal detection unit;

a signal comparator connected to the receiver for comparing the encoded signal to known patterns and activating a circuit;

at least one illumination device connected to the signal comparator and the battery for indicating the detection of the signal; and an oscillator connected between the illumination device and the battery to produce a flashing effect in the illumination device.

2. A new and improved emergency vehicle detection system for alerting a driver of an approaching emergency vehicle comprising, in combination:

a sound signal-producing unit mounted on an emergency vehicle, the sound signal-producing unit including:

a sound generator for producing and transmitting a sound signal;

a siren connected to the sound generator;

a sound signal detection unit mounted on a vehicle, the sound signal detection unit including:

at least one sound transducer connected to an existing vehicle electrical system for detecting sound signals and producing an electric current;

a signal comparator connected to the transducer for comparing the current from the transducer to preprogrammed patterns;

a signal output encoder connected to the signal comparator for constructing an encoded signal according to the current from the signal comparator;

a transmitter connected to the signal output encoder and to the vehicle electrical system for transmitting the encoded signal from the signal output encoder through an antenna;

a display unit mounted on a vehicle, the display unit comprising:

a receiver connected to a battery and an antenna for receiving the encoded signal from the transmitter of the sound signal detection unit;

a signal comparator connected to the receiver for comparing the encoded signal to known patterns and activating a circuit; and at least one signal device located in the display unit connected to the signal comparator and the battery for indicating the detection of a signal.

3. The emergency vehicle detection system as set forth in claim 2 wherein the switch has a first position for deactivating the ultra-sound generator, a second position for activating the ultra-sound generator and a third position for automatically activating the ultra-sound generator upon activation of the siren.

4. The emergency vehicle detection system as set forth in claim 3, and further comprising a logic gate for activating the sound generator corresponding to the position of the switch.

5. The emergency vehicle detection system as set forth in claim 2 wherein the sound transducer is a specific frequency directional sound transducer.

6. The emergency vehicle detection system as set forth in claim 2, and further comprising a signal strength detector connected to the signal comparator for activating a circuit corresponding to the strongest currents and inhibits the circuits of the weaker currents from the signal comparator.

7. The emergency vehicle detection system as set forth in claim 6, and further comprising a signal strength change detector connected to the signal strength detector and to the signal output encoder for completing a circuit corresponding to a detected increasing signal a decreasing signal from the signal strength detector.

8. The emergency vehicle detection system as set forth in claim 2 wherein the transmitter is a radio transmitter.

9. The emergency vehicle detection system as set forth in claim 2 wherein the receiver is single channel radio receiver.

10. The emergency vehicle detection system as set forth in claim 2 wherein the illumination device is at least one light emitting diode arrow.

11. The emergency vehicle detection system as set forth in claim 2 further comprising an oscillator connected between the illumination device and the battery to produce a flashing effect in the illumination device.

* * * * *